US007594584B2

(12) United States Patent
Durdon et al.

(10) Patent No.: US 7,594,584 B2
(45) Date of Patent: Sep. 29, 2009

(54) CUP LID HAVING A ROTATABLE STOPPER

(75) Inventors: Terrance N. Durdon, Guelph (CA); Valentin Augustin Buzan, Mississauga (CA); Pieter W. Lubbe, Mississauga (CA)

(73) Assignee: Amhil Enterprises, Mississauga (CA)

( * ) Notice: Subject to any disclaimer, the term of this patent is extended or adjusted under 35 U.S.C. 154(b) by 420 days.

(21) Appl. No.: 11/458,383

(22) Filed: Jul. 18, 2006

(65) Prior Publication Data

US 2007/0029322 A1 Feb. 8, 2007

Related U.S. Application Data

(60) Provisional application No. 60/700,347, filed on Jul. 19, 2005.

(51) Int. Cl.

| | |
|---|---|
| ***B65D 51/18*** | (2006.01) |
| ***B65D 3/00*** | (2006.01) |
| ***B65D 43/18*** | (2006.01) |
| ***A47G 19/22*** | (2006.01) |

(52) U.S. Cl. ..... 220/254.4; 220/253; 220/713; 220/714; 220/716; 220/719; 220/404; 220/906.1

(58) Field of Classification Search ..... 220/713–715, 220/719, 254.4, 253, 821, 716; 222/480; 229/404, 906.1

See application file for complete search history.

(56) References Cited

U.S. PATENT DOCUMENTS

| | | | | |
|---|---|---|---|---|
| 3,598,271 | A * | 8/1971 | Holley | 215/227 |
| 4,795,052 | A | 1/1989 | Hayes, Jr. | |
| 6,578,726 | B1 * | 6/2003 | Schaefer | 220/253 |
| D478,006 | S | 8/2003 | Smith et al. | |
| D480,968 | S | 10/2003 | Atkins et al. | |
| 6,644,490 | B2 | 11/2003 | Clarke | |
| 2002/0170912 | A1 | 11/2002 | Clarke | |
| 2003/0024929 | A1 | 2/2003 | Smith et al. | |
| 2003/0024930 | A1 | 2/2003 | Smith et al. | |
| 2003/0089713 | A1 | 5/2003 | Belt et al. | |
| 2003/0089714 | A1 | 5/2003 | Dart et al. | |
| 2003/0197012 | A1 | 10/2003 | Smith et al. | |
| 2004/0035868 | A1 | 2/2004 | Smith et al. | |

(Continued)

FOREIGN PATENT DOCUMENTS

| | | | |
|---|---|---|---|
| FR | 2166292 | A1 | 8/1973 |

(Continued)

*Primary Examiner*—Robin Hylton
(74) *Attorney, Agent, or Firm*—Gowan Intellectual Property; Gerald A. Gowan

(57) ABSTRACT

A cup lid comprising a base cup lid having a drink-through opening formed therein in a planar top portion thereof, and a rotatable stopper associated therewith so as to selectively provide a sealed and unsealed relationship between said drink-through opening and a opening in said rotatable stopper. The base cup lid and the rotatable stopper are mated to one another by the use of convoluted portions on each part which form a sliding tongue and groove relationship. The rotatable stopper has an actuator that can be used to move the rotatable stopper from a closed position wherein the opening in the rotatable stopper and the drink-through opening in the base cup lid, are not aligned, to an open position where the opening in the rotatable stopper and the drink-through opening in the base cup lid, are aligned. An easily operated resealable cup lid is provided.

15 Claims, 8 Drawing Sheets

U.S. PATENT DOCUMENTS

| | | | | |
|---|---|---|---|---|
| 2004/0076777 | A1* | 4/2004 | Bayss et al. | 428/34.1 |
| 2004/0089662 | A1* | 5/2004 | Smith et al. | 220/253 |
| 2004/0094549 | A1 | 5/2004 | Ryan et al. | |
| 2006/0027588 | A1 | 2/2006 | Mackovic-Basic et al. | |
| 2006/0096983 | A1 | 5/2006 | Patterson | |

FOREIGN PATENT DOCUMENTS

| | | |
|---|---|---|
| GB | 2202212 A | 9/1988 |
| WO | WO 2003/047994 | 6/2003 |

* cited by examiner

CUP LID HAVING A ROTATABLE STOPPER

RELATED APPLICATIONS

This application claims the benefit of priority under 35 U.S.C. § 119(e) to U.S. Provisional Application Ser. No. 60/700,347 filed on Jul. 19, 2005, the entirety of which is hereby incorporated by reference.

FIELD OF THE INVENTION

This invention relates to cup lids, and particularly relates to cup lids which have two independent parts, which parts cooperate one with the other to provide a resealable drink-through opening formed in the cup lid.

BACKGROUND OF THE INVENTION

Beverages have been dispensed for many years in disposable cups, and typically each disposable cup is provided with a disposable lid. Very often, after the beverage has been obtained from the vendor or dispenser, and has been covered with the lid, it is carried by the consumer to another place where the beverage will be consumed. At that time, the consumer may choose to remove and dispose of the lid, or retain it for future replacement over the cup, or a portion of the lid may be folded back from the rim of the cup to provide an opening through which the beverage may be consumed. Other lids are provided, particularly of the dome lid variety which are used to cover hot beverages such as coffee or cappuccino, and which extend above the rim of the cup. Often, those dome lids have a drink-through opening which is punched into a planar portion of the cup lid above the plane of the rim of the cup. Consequently, the drink-through opening is permanently open.

In many circumstances, such as in sports stadia and the like, where there are likely to be crowds in the area where beverages are being dispensed, and where very often a consumer will obtain more than one beverage at a time for himself and/or his companions, and where there is risk of spillage of the beverage should the cup lid be removed from the cup, it is desirable for there to be a drink-through opening in the cup lid which can be resealed at times when the beverage is not being consumed. This has several advantages, including reducing the risk of spillage as a consequence of being jostled or the like, and in the case where the beverage is a hot beverage, cooling of the beverage is retarded if the cup lid has been resealed.

Indeed, it is particularly for the reason that there is a risk of spillage of a hot beverage through the drink-through opening that the present invention seeks to provide a cup lid having a drink-through opening that can be selectively sealed and resealed at will. This feature is particularly advantageous in the many instances where cups of a hot beverage are dispensed through a sales or delivery window to a waiting driver in a vehicle who is making his/her purchase at a so-called drive-through window. There may be a significant difference in elevation between the service window and that of the vehicle, or there may be inclement or windy weather, or other reasons including inattention, carelessness, or accident, where hot beverage might spill over the hands of either the service person or the customer through an unsealed drink-through opening in a cup lid covering the beverage.

For that purpose, the present invention provides a cup lid which can be unsealed so as to provide free access to the drink-through opening, but which can be resealed so as to provide a liquid seal to preclude spillage, as well as to retard cooling of the beverage in the event that it is a hot beverage.

The prior art which is known to the Applicant herein, which has to do with cup lids having drink-through openings and sealing or cover arrangements therefore, but which is not believed otherwise to be relevant to the present invention, is as follows, U.S. Pat. No. 4,795,052; U.S. Pat. No. 6,644,490; U.S. Design Pat. No. D478006; U.S. Design Pat. No. D480968; Published United States Patent Application 2002/0170912; Published United States Patent Application 2003/0024929 (and its Continuation 2003/0197012 and its Division 2004/0035868); Published United States Patent Application 2003/0024930; Published United States Patent Application 2003/0089713; Published United States Patent Application 2003/0089714; Published United States Patent Application 2006/0027588, Published United States Patent Application 2004/0094549, and Published United States Patent Application 2006/0096983.

SUMMARY OF THE INVENTION

Accordingly, it is a principal objective of the present invention to provide a cup lid which is simple to operate in order to temporarily close the drink-through opening of a cup lid. It is a further objective of the present invention to provide a cup lid having a reduced potential for accidental spillage.

The advantages set out hereinabove, as well as other objects and goals inherent thereto, are at least partially or fully provided by the cup lid of the present invention, as set out herein below.

Accordingly, in one aspect, the present invention provides a cup lid comprising a base cup lid having a drink-through opening formed therein in a first planar top portion thereof, and a rotatable stopper associated therewith so as to selectively provide a sealed and unsealed relationship between said drink-through opening and said rotatable stopper;

wherein said rotatable stopper has a first planar portion, a second convoluted portion, a third planar portion, and a centrally located actuating portion having an actuator, and preferably a linear or cruciform shaped actuator formed therein;

wherein an opening is formed in said first planar portion of said rotatable stopper so that when rotated to be in alignment with said drink through opening, a liquid passage is provided through said opening in said rotatable stopper and through said drink-through opening in said base cup lid;

wherein said base cup lid has a second convoluted portion below said first planar top portion, and a third planar portion below said second convoluted portion;

wherein said second convoluted portions of both said base cup lid and said rotatable stopper are dimensioned so that a slidable and rotatable, preferably tongue and groove, relationship between them is achieved when they are assembled together with said first planar portion of said rotatable stopper being below said first planar top portion of said base cup lid;

wherein said first planar portion of said rotatable stopper is preferably formed so as to be biased upwardly against the lower surface of said first planar top portion of said base cup lid when assembled thereto; and wherein said third planar portion of said base cup lid is preferably biased downwardly against the upper surface of said third planar portion of said rotatable stopper when assembled thereto;

whereby when said base cup lid and said rotatable stopper are assembled one to the other so as to have a rotatable and sliding relationship therebetween, said drink-through opening in said base cup lid is selectively sealable and unsealable by rotation of said rotatable stopper.

A particular feature of the present invention is that the rotatable stopper element and base cup lid are assembled together in such a manner that they enjoy a sliding and rotatable relationship one with the other, while at the same time each of the rotatable stopper element and the base cup lid are biased against each other for purposes of sealing and to assure the integrity of the sliding and rotatable relationship. That sliding and rotatable relationship is attained by an arrangement of mating convoluted portions whereby preferably alternating slidable tongue and groove-like engagements are provided.

The seal is provided by a rotatable stopper which moves rotatably between an open and a closed position.

The rotatable stopper is provided with an opening, such as a opening which has been cut or punched into the first planar surface, or a baffle formed from the side of the first planar surface, so that, when it is assembled to the base cup lid and the opening in the rotatable stopper is aligned with the drink-through opening in the base cup lid, a liquid passage for beverage within the cup is provided.

When rotated, the opening in the first planar surface of the rotatable stopper will be moved away from the drink-through opening in the base cup lid. As a result, a solid section of the first planar surface of the rotatable stopper will act to close and/or seal the drink-through opening in the base cup lid.

Additionally, a protrusion can be formed in the rotatable stopper so as to extend upwardly through the drink-through opening in the base cup lid, and at least that portion of the rotatable stopper is biased upwardly against the underside of the base cup lid so as to provide a liquid seal and can provide a positive stop for rotation of the rotatable stopper from its open to its closed position. The protrusion is preferably substantially the same shape as the drink-through opening in the base cup lid.

BRIEF DESCRIPTION OF THE DRAWINGS

Embodiments of this invention will now be described by way of example only in association with the accompanying drawings in which.

DETAILED DESCRIPTION OF THE PREFERRED EMBODIMENTS

Figure 1:
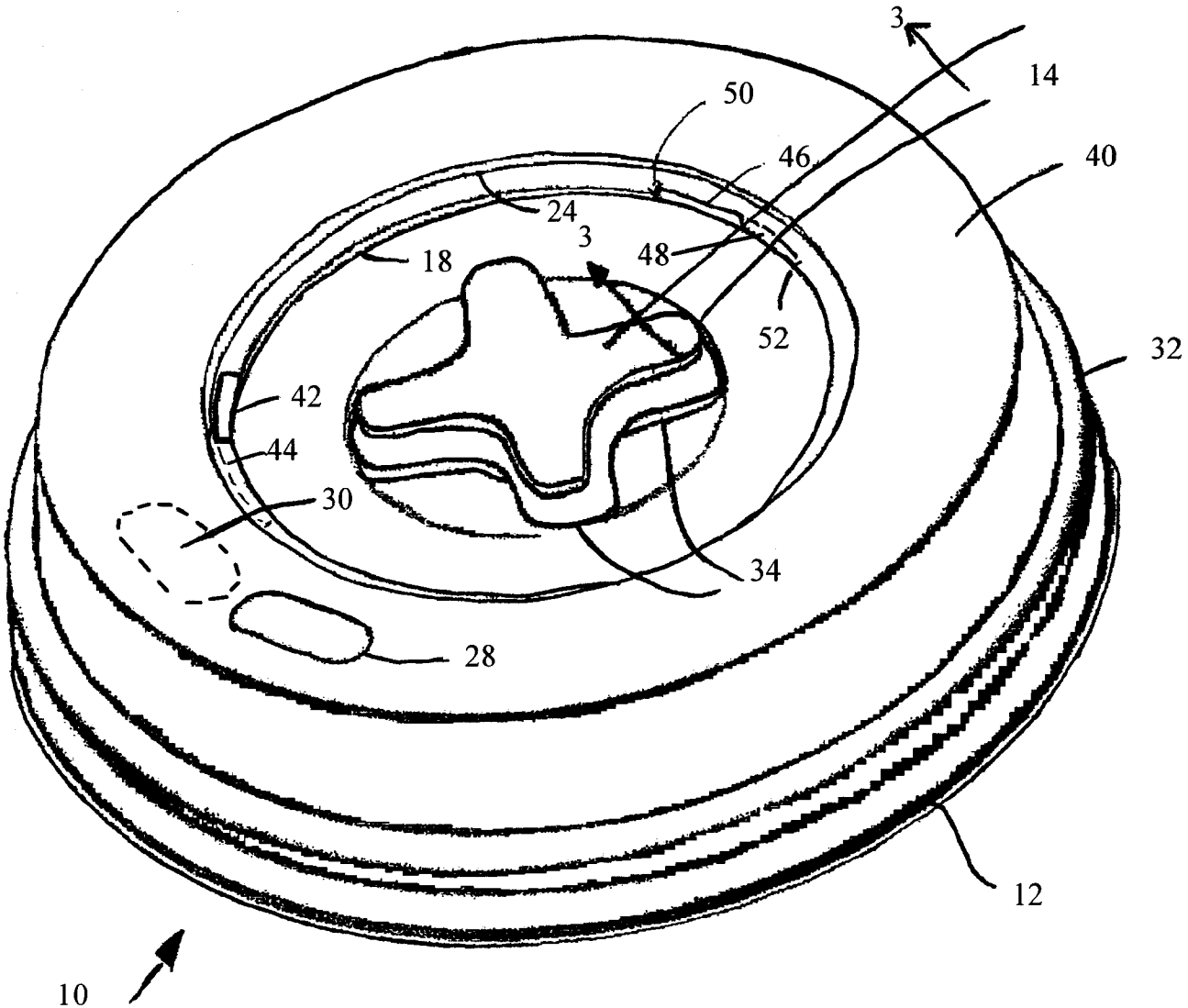
FIG. 1 shows an assembled cup lid with a base cup lid and a rotatable stopper, where the stopper has been rotated to a closed position.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, the combination of an outer section of a base cup lid 12 and rotatable stopper element 14 are shown together as a complete, assembled cup lid, in combination, at 10. The base cup lid 12 has a drink-through opening 28 formed therein; and the rotatable stopper element 14 has an opening 30 (shown in outline) formed therein, which is dimensioned so as to underlie the drink-through opening 28 when the rotatable stopper element 14 is rotated to the open position. In the closed position shown in FIG. 1, the drink-through opening 28 is closed and a liquid seal is formed. When the rotatable stopper element 14 is rotated so that the opening 30 and the drink-through opening 28 are aligned, then a liquid passage through them is provided so as to permit consumption of the beverage contained in the cup in keeping with the present invention.

Figure 2:
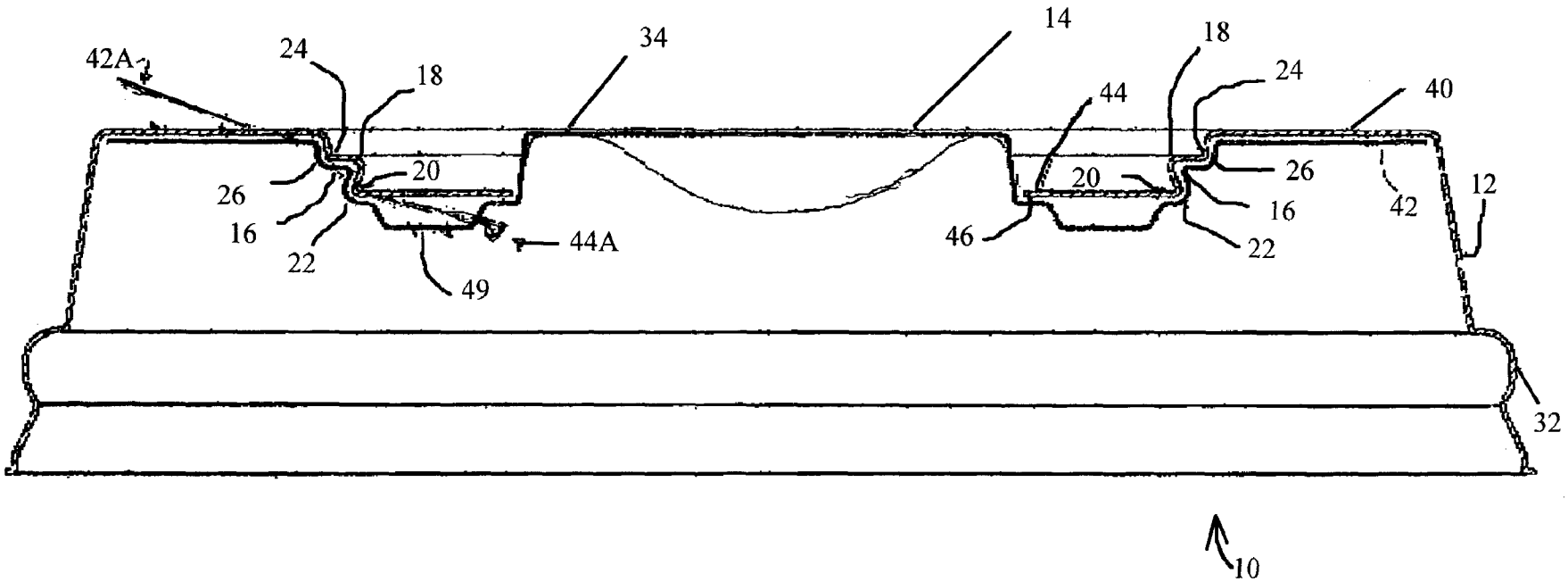
FIG. 2 is a cross-section of the assembled cup lid of FIG. 1.

The assembly of the rotatable stopper element 14 to the base cup lid 12 is best understood by reference to FIG. 2, especially to the right hand portion thereof. Here, it will be seen that the rotatable stopper element 14 has a first planar portion 42, a second convoluted portion 26, 16, 22, and a third substantially planar portion 46. It will be understood that the third planar portion 46, in this configuration of the rotatable stopper element 14, is depressed, so as to accommodate either a drip opening or a vent opening shown generally at 49.

It can also be seen, that this configuration of base cup lid 12 comprises a first planar top portion 40, a second convoluted portion 24, 18, 20 which is below the first planar top portion 40, and a third planar portion 44 which is below the second convoluted portion.

Now it will be understood that the pairs of cooperating "tongues and grooves" 24, 26; 16, 18; and 20, 22, from the base cup lid 12 and the rotatable stopper, provide for a slidable and rotatable relationship between the base cup lid 12 and the rotatable stopper 14, while at the same time assuring that the base cup lid 12 and the rotatable stopper 14 are securely assembled one to the other.

Referring to the left hand portion of FIG. 2, it will be understood that prior to mating base cup lid 12 with rotatable stopper element 14, the first planar portion 42 of the rotatable stopper element 14 is preferably biased upwardly as shown at 42A. Also, it will be understood that the third planar portion 44 of the base cup lid 12 is preferably biased downwardly as shown at 44A, prior to assembly. As a result, when the two components 12 and 14 are mated, appropriate sealing between the elements is assured.

In FIG. 1, it can be noted that the size of the opening 30 formed in the rotatable stopper element 14 will be preferably at least the same size as the drink-through opening 28 formed in the base cup lid 12. It will be understood, however, that they may be the same size; and if so, both openings may be punched at the same time after the base cup lid and the rotatable stopper element have been assembled together.

Figure 4:
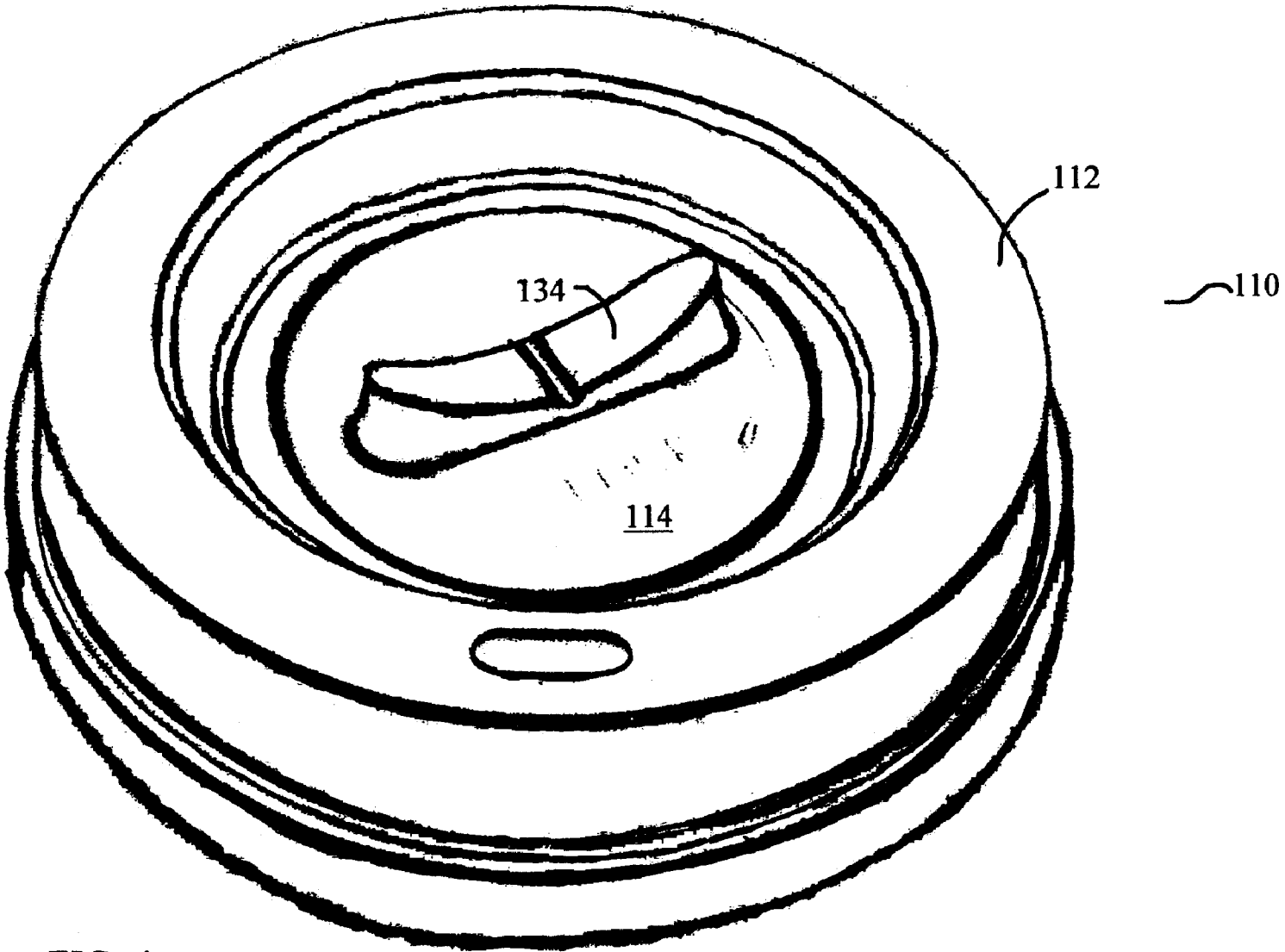
FIG. 4 shows a second embodiment of an assembled cup lid in a closed position.
Figure 9A:
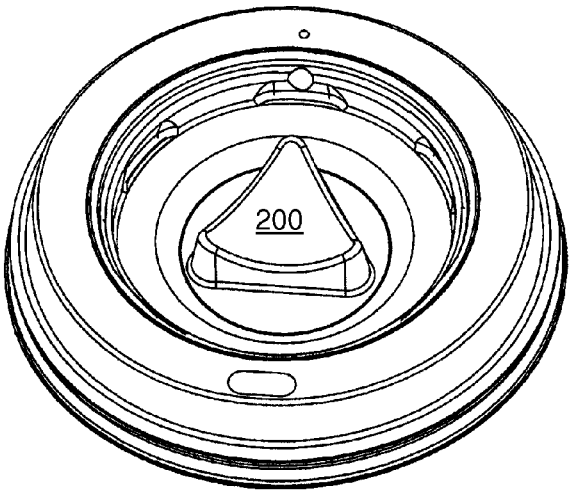
FIG. 9A-9C are perspective views of the cup lid of FIG. 1 having different actuator Shapes.
Figure 9B:
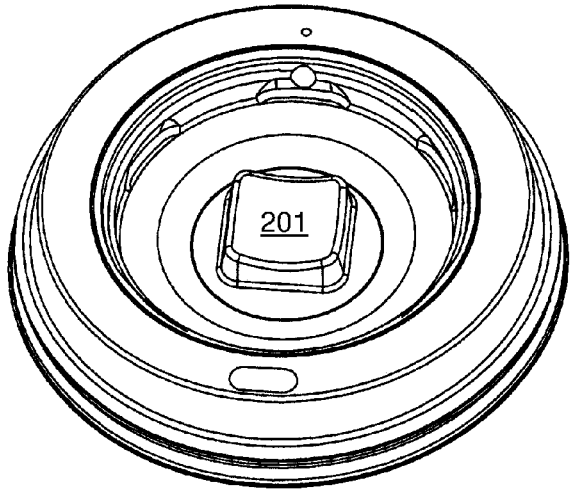
Figure 9C:
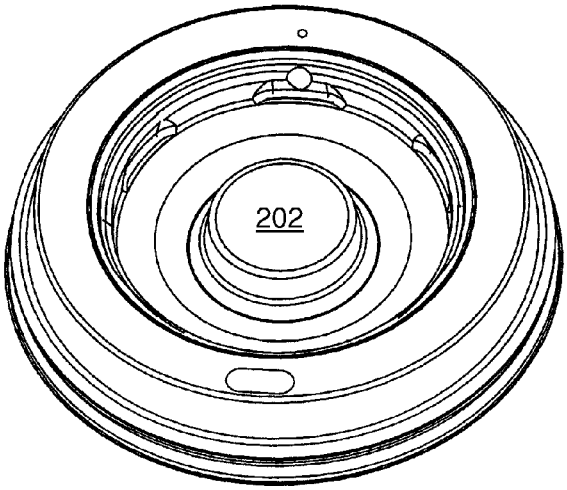

Movement, or actuation of the rotatable stopper element 14 is easily effected by engagement of actuator 34. While actuator 34 is shown having a cruciform configuration in this embodiment, other configurations such as a linear, as seen in FIG. 4, or a triangular, a square or a circular actuator shape, as seen in FIGS. 9A, 9B and 9*c* respectively, might also be utilized.

Actuator 34 is shown as being roughly equal in elevation as the first planar portion 42. However, actuator 34 can be any convenient or suitable height provided that it permits rotatable stopper 14 to be moved.

Figure 3:
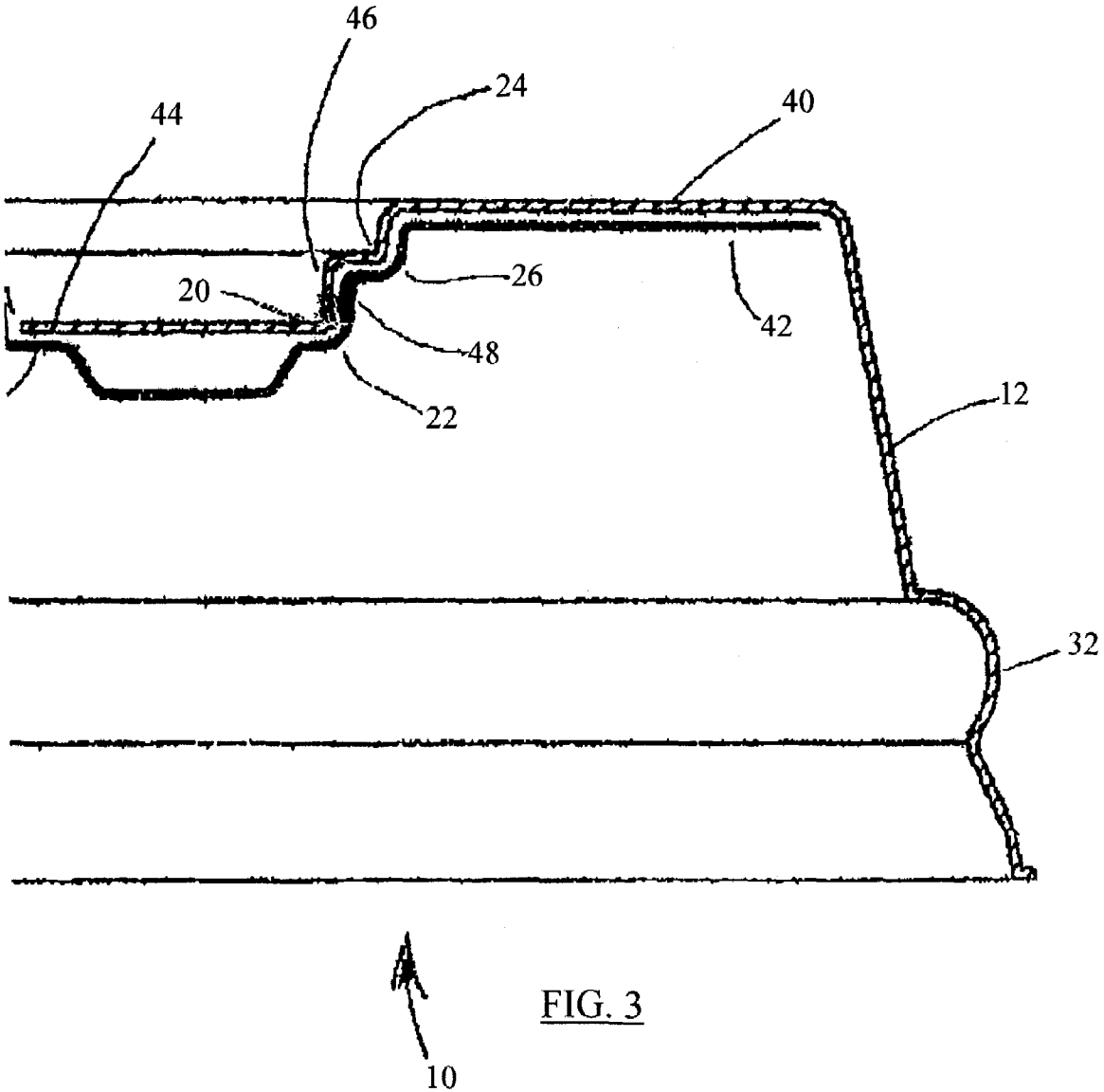
FIG. 3 is a partial cross-section looking along lines 3-3 in FIG. 1.

The limits of rotation of rotatable stopper element 14 are preferably determined by pairs of downwardly directed vertical sections formed, respectively, in the base cup lid 12 and rotatable stopper element 14. As seen in FIG. 1, there is a detent 42 with a cooperating detent 44, and a detent 46 with a cooperating detent 48. As seen in FIG. 3, the detents 46, 48 (and also the detents 42, 44, when present) are substantially vertical. They are formed in the respective convoluted portions 18 and 16 of the base cup lid 12 and the rotatable stopper element 14. There are end walls formed between the detents and the respective convoluted sections where they are formed, so that interference of one end wall in one detent with the end wall of the cooperating detent forms a stop which, in turn, limits the amount of rotation of the rotatable stopper element 14 within the base cup lid 12, as is otherwise permitted by the slidable relationship between them.

A first stop 50 is shown in FIG. 1, and it serves to limit the clockwise rotation of the rotatable stopper element 14 when in its closed position. A second stop 52 serves to limit the counter-clockwise rotation of the rotatable stopper element 14 when it is rotated to its open position, at which position the opening 30 and the drink-through opening are in alignment one with the other.

The substantially vertical arrangement of the detents 42, 44, 46, 48 also serves to assist in stripping the base cup lid 12 and the rotatable stopper element 14 from the molds on which they have been thermoformed.

In FIG. 4, a second embodiment of the present invention is shown in which an assembled lid 110 comprises a base cup lid 112 and rotatable stopper element 114. In this embodiment, actuator 134 has a linear shape.

Figure 5:
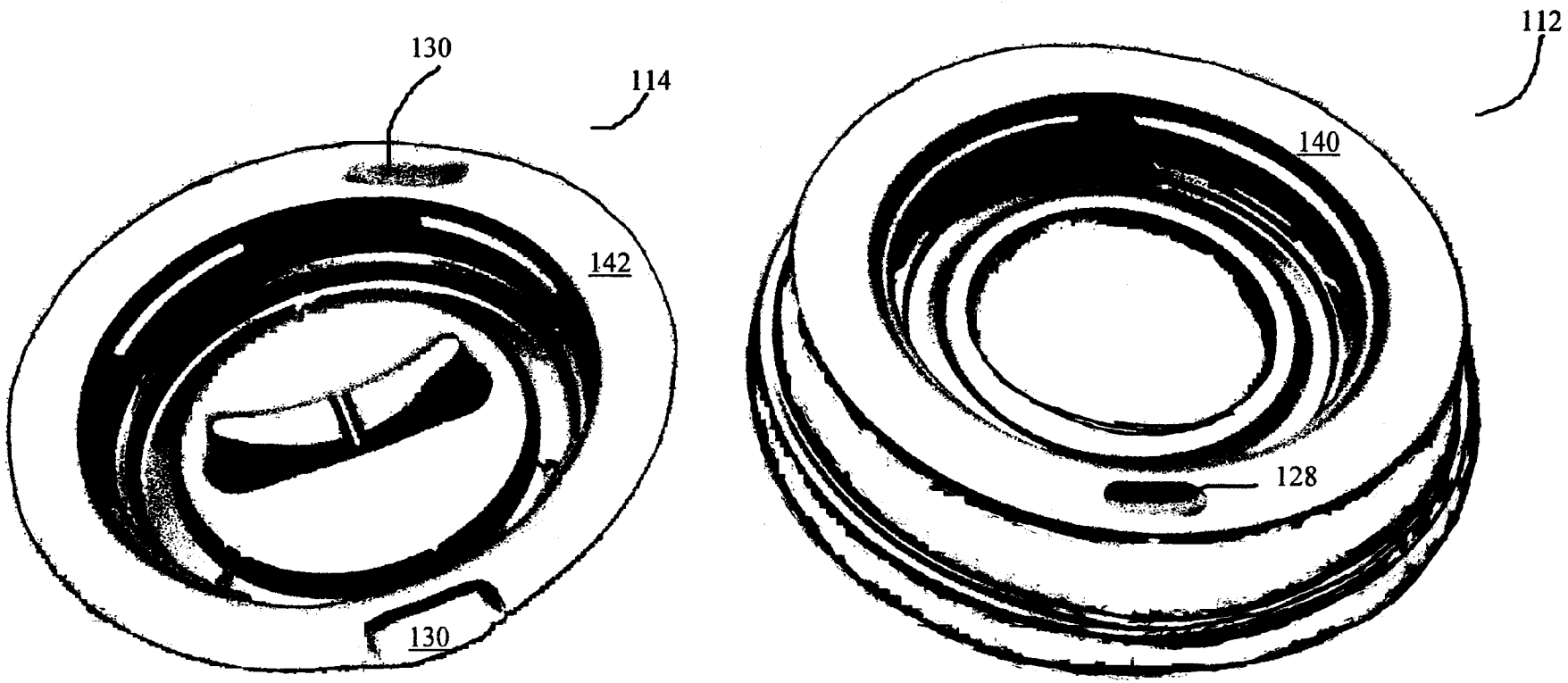
FIG. 5 shows the separated components of the assembled cup lid of FIG. 4.

The separated base cup lid 112 and rotatable stopper element 114, that make up assembled lid 110, are shown in FIG. 5. Details of the various convoluted areas, and planar elements can be seen more clearly. In particular first planar area 142 of rotatable stopper element 114 can be seen, and it can clearly be seen that this planar area is adapted to fit underneath and within first planar area 140 of base cup lid 112.

Also, in this embodiment, it can be noted that cut-out opening 30 in rotatable stopper element 14 has been replaced with one of two baffle sections 130 in rotatable stopper 114. Baffles 130 now act as, or create an opening, and are preferably built into the rotatable stopper 114, or can be added as a separate piece which is attached to rotatable stopper 114 by heat staking, ultrasonic welding, glue, or the like.

When assembled together and cup 110 is in an open position, one of baffle sections 130 is located below opening 128 in base cup lid 112. Liquid from the cup is allowed to pass around baffle section 130 and then out of opening 128. With the use of baffle section 130, the flow rate of liquid out of opening 128 is reduced and is generally more controllable over merely a opening in first planar surface of rotatable stopper 14. This also limits the rate at which liquid can spill out of the cup should the cup inadvertently be knocked or knocked over while the rotatable stopper 114 of assembled cup lid 110 is in an open position.

Figure 6:
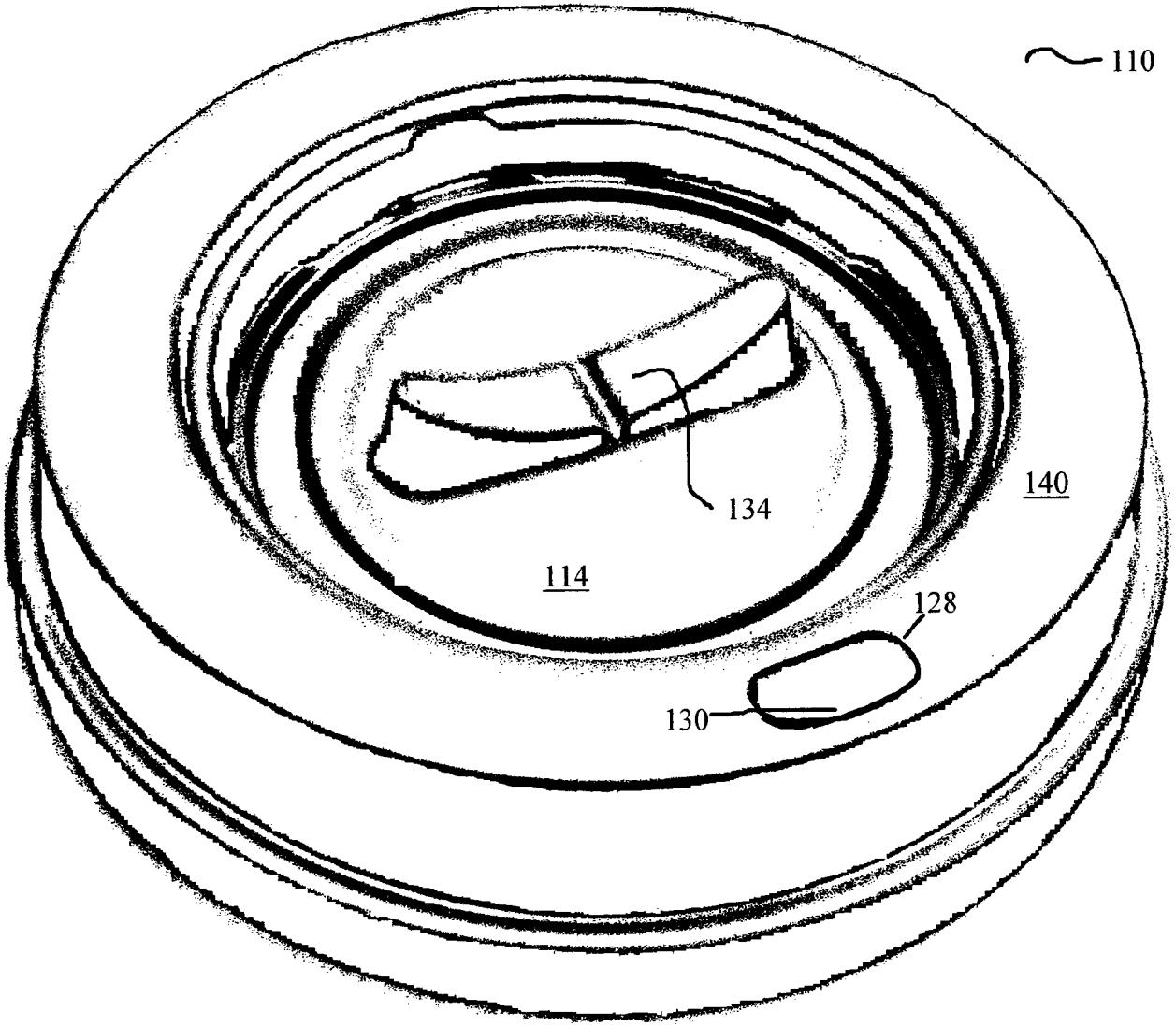
FIG. 6 shows the assembled cup lid with rotatable stopper of FIG. 5 in an open positions.

A view of the assembled cup lid 110 of FIGS. 4 and 5, in an open position is shown in FIG. 6.

Figure 7:
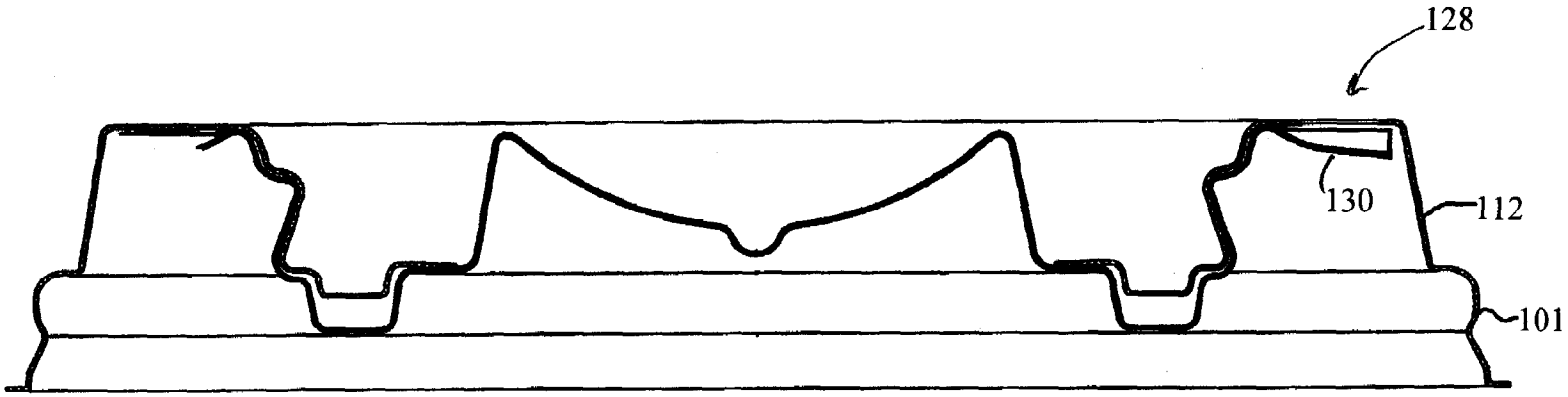
FIG. 7 is a cross-section of the cup of FIG. 6.

Further details of the baffle section construction can be seen in FIG. 7 which is a cross-sectional view of the assembled cup lid 110 of FIG. 6. It can clearly be seen that liquid from the cup can pass around baffle section 130, and exit from the cup through opening 128.

Figure 8:
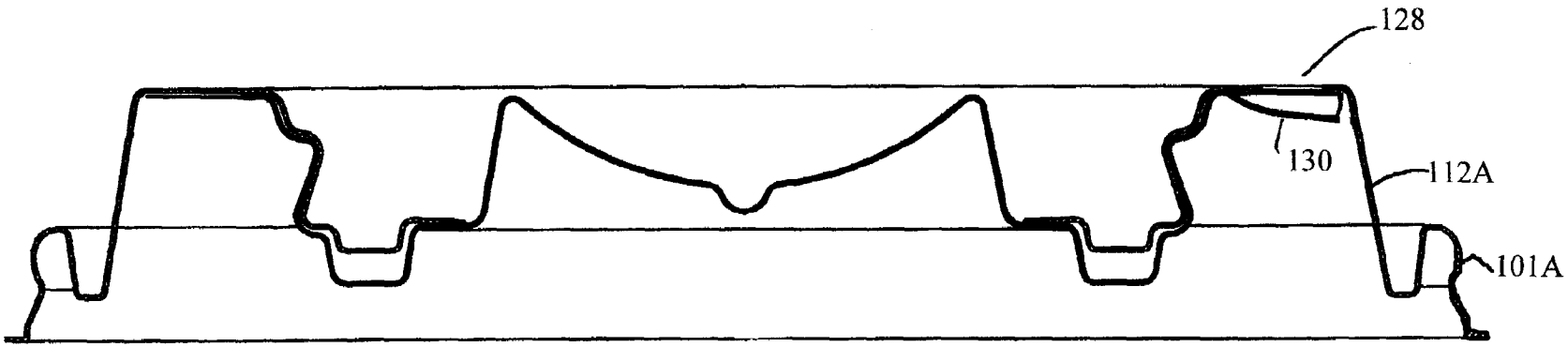
FIG. 8 is a cross-section of a third embodiment of the present invention, which equates to the view shown in FIG. 7, but has a different cup rim structure.

Assembled cup lids 10 or 110 are, of course, intended to be placed over the open upper end of a drinking cup (not shown). Typically, such a drinking cup may be made from plastic or other coated paper, polystyrene, styrene, or otherwise. The drinking cup will have a substantially circular cup rim which lies substantially in a single plane. In FIG. 7, the rim 101 of the base cup lid 112 has a configuration adapted to receive the circular rim of a cup. In FIG. 8, rim 101A is provided on base cup lid 112A, which is better suited for providing a plug fit over the cup rim.

In FIGS. 9A, 9B and 9C, alternative actuator shapes are shown. In FIG. 9A, a triangular actuator 200 is used. In FIG. 9B, a square actuator 201 is shown, and in FIG. 9C, a circular actuator 202, is shown.

The components of the assembled cup lid are preferably constructed from a sheet of plastic material suitable for forming such lids. Typically, the cup lid components will be thermoformed from an extruded plastic sheet material. Also, since the base cup lid and rotatable stopper of the present invention are intended to seal cups with hot beverages, the rotatable stopper and base cup lid material must be capable of withstanding the typical serving temperatures of hot beverages such as coffee, tea, cappuccino, hot chocolate and the like. However, the present lid can also be used for cold beverages and, therefore, can be formed of the types of plastic generally used for cold beverage lids.

Base cup lid and/or rotatable stopper can also be manufactured from, or covered with, temperature indicating materials or coatings. These thermochromatic materials can provide indications of an elevated temperature of the liquid materials in the drinking cup.

Thus, it is apparent that there has been provided, in accordance with the present invention, a cup lid which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

We claim:

1. A cup lid comprising a base cup lid having a drink-through opening formed therein in a first planar top portion thereof, and a rotatable stopper associated therewith so as to selectively provide a sealed and unsealed relationship between said drink-through opening and said rotatable stopper;

wherein said rotatable stopper has a first planar portion, a second convoluted portion, a third planar portion, and a centrally located actuating portion having an actuator formed therein;

wherein an opening is formed in said first planar portion of said rotatable stopper so that when rotated to be in alignment with said drink through opening, a liquid passage is provided through said opening in said rotatable stopper and through said drink-through opening in said base cup lid;

wherein said base cup lid has a second convoluted portion below said first planar top portion, and a third planar portion below said second convoluted portion;

wherein said second convoluted portions of both said base cup lid and said rotatable stopper are dimensioned so that a slidable and rotatable relationship between them is achieved when they are assembled together with said first planar portion of said rotatable stopper being below said first planar top portion of said base cup lid; and whereby when said base cup lid and said rotatable stopper are assembled one to the other so as to have a rotatable and sliding relationship therebetween, said drink-through opening in said base cup lid is selectively sealable and unsealable by rotation of said rotatable stopper.

2. A cup lid as claimed in claim 1 wherein said first planar portion of said rotatable stopper is preferably formed so as to be biased upwardly against the lower surface of said first planar top portion of said base cup lid when assembled thereto; and wherein said third planar portion of said base cup lid is preferably biased downwardly against the upper surface of said third planar portion of said rotatable stopper when assembled thereto.

3. A cup lid as claimed in claim 1 wherein said second convoluted portion of said base cup lid and said second convoluted portion of said rotatable stopper have a tongue and groove relationship.

4. A cup lid as claimed in claim 1 wherein said actuator has a cruciform, linear, triangular, square or a circular shaped actuator.

5. A cup lid as claimed in claim 1 wherein said actuator has a linear or cruciform shaped actuator.

6. A cup lid as claimed in claim 1 wherein a protrusion is formed in the rotatable stopper so as to extend upwardly through the drink-through opening in the base cup lid, and at least that portion of the rotatable stopper is biased upwardly against the underside of the base cup lid so as to provide a liquid seal and can provide a positive stop for rotation of the rotatable stopper from its open to its closed position.

7. A cup lid as claimed in claim 6 wherein said protrusion is preferably substantially the same shape as the drink-through opening in the base cup lid.

8. A cup lid as claimed in claim 1 wherein said base cup lid and said rotatable stopper have one or more corresponding detents that limit rotation of said rotatable stopper.

9. A cup lid as claimed in claim 8 wherein said detents are essentially vertical sections in said second convoluted portions of said base cup lid and said rotatable stopper.

10. A cup lid as claimed in claim 9 wherein said detents form a first stop which stops said rotatable stopper in a closed position, and form a second stop wherein said rotatable stopper is in a open position.

11. A cup lid as claimed in claim 1 wherein said opening in said rotatable stopper is at least the same size as the drink-through opening formed in said base cup lid.

12. A cup lid as claimed in claim 1 wherein said opening in said rotatable stopper is created by a baffle.

13. A cup lid as claimed in claim 1 wherein said base cup lid and/or said rotatable stopper are thermoformed from an extruded plastic sheet material.

14. A cup lid as claimed in claim 1 wherein said base cup lid and/or said rotatable stopper are manufactured from, or are covered with, temperature indicating materials or coatings.

15. A cup lid as claimed in claim 14 wherein said temperature indicating materials or coatings comprise a thermochromatic material.

* * * * *